US005349160A

United States Patent [19]

Hazan et al.

[11] Patent Number: 5,349,160

[45] Date of Patent: Sep. 20, 1994

[54] IRON COMPRISING A HUMIDITY DETECTOR FOR CONTROLLING THE HEATING ELEMENT AND ALSO PROVIDING A MOTION INDICATION

[75] Inventors: Jean-Pierre Hazan, Sucy En Brie; Rémy Polaert, Villecresnes; Jean-Louis Nagel, Limeil Brevannes, all of France

[73] Assignee: U.S. Philips Corporation, New York, N.Y.

[21] Appl. No.: 914,987

[22] Filed: Jul. 16, 1992

[30] Foreign Application Priority Data

Jul. 19, 1991 [FR] France ..... 91 09132

[51] Int. Cl.[5] ..... H05B 1/02; D06F 75/08

[52] U.S. Cl. ..... 219/250; 38/75; 38/82; 219/245; 219/509; 324/695

[58] Field of Search ..... 219/245, 246–259, 219/509; 38/1 C, 82, 75, 77.1–77.83, 74; 34/48, 96, 50; 324/694, 695, 696

[56] References Cited

U.S. PATENT DOCUMENTS 2,313,917 3/1943 Brownlee .
2,313,918 3/1943 Brownlee .
2,395,787 2/1946 Ledbetter et al. .
3,040,807 6/1962 Chope ..... 34/48
4,877,042 10/1989 Downey ..... 34/96

FOREIGN PATENT DOCUMENTS 2421431 11/1975 Fed. Rep. of Germany ..... 219/250
2548588 5/1977 Fed. Rep. of Germany .
3444348 6/1986 Fed. Rep. of Germany .

*Primary Examiner*—Anthony Bartis
*Attorney, Agent, or Firm*—Ernestine C. Bartlett

[57] ABSTRACT

An iron comprises a heating element (97) and heating-control means (96) for the heating element. It has a humidity detector (60) which measures the degree of humidity of the fabric and which influences the electric power dissipated in the heating element. In order to measure the degree of humidity a circuit (99) measures the resistivity of the fabric between two contact electrodes (62*a*, 62*b*) and subsequently averages the electric signal resulting from the movement of the iron on the fabric. A circuit (89) may be added which measures the rhythm of the variations of said electric signal and which thus detects whether the iron is in use or not in use.

10 Claims, 2 Drawing Sheets

IRON COMPRISING A HUMIDITY DETECTOR FOR CONTROLLING THE HEATING ELEMENT AND ALSO PROVIDING A MOTION INDICATION

FIELD OF THE INVENTION

The invention relates to an iron comprising a heating element, heating control means for the heating element, and a substantially flat soleplate adapted to slide on a fabric.

BACKGROUND OF THE INVENTION

The ironing conditions of a fabric may depend to a considerable extent on the moistness of the fabric. It is known that ironing of a damp fabric is preceded by a fabric dehumidifying step. For certain thermostat settings the electric power dissipated in the heating element may be low, which prolongs the dehumidifying step. This results in excessively long ironing times.

To date designers of irons have not dealt with this problem. It is an object of the invention to provide a humidity detector for an iron which can be manufactured more easily in large numbers, which is essential for such a mass product, and which can be used easily for controlling the dissipated electric power.

SUMMARY OF THE INVENTION

This object is achieved in that the iron has a humidity detector comprising:

means for measuring a resistivity of the fabric, which means are flush with the soleplate of the iron to enable it to be brought into contact with the fabric, and means for determining an average degree of humidity of the fabric by measuring an electric signal I resulting from variations of the resistivity caused by a movement of the iron over the fabric.

The means for measuring the resistivity comprise at least one electrode which is flush with the soleplate of the iron to enable it to be brought into contact with the fabric.

The electrical resistance between two electrodes can be measured by means of a suitable circuit. A small value of the electrical resistance is characteristic of a moist fabric. A large value of the electrical resistance is characteristic of a dry fabric.

The passage of the iron through zones which generally do not have the same humidity enables the humidity detector to supply an electric signal which varies depending on the position of the iron on the fabric.

In order to measure an average degree of humidity of the fabric an average value of the electric signal I is calculated.

It is also possible to determine the rhythm of the variations of the electric signal. By means of such a rhythm it is possible to determine whether the iron is still in use. Thus, the humidity detector can also provide a movement indication.

BRIEF DESCRIPTION OF THE DRAWINGS

The invention will be more fully understood by means of the following drawings, which are given by way of non-limitative example and in which.

DESCRIPTION OF EMBODIMENTS PREFERRED

Figure 1:
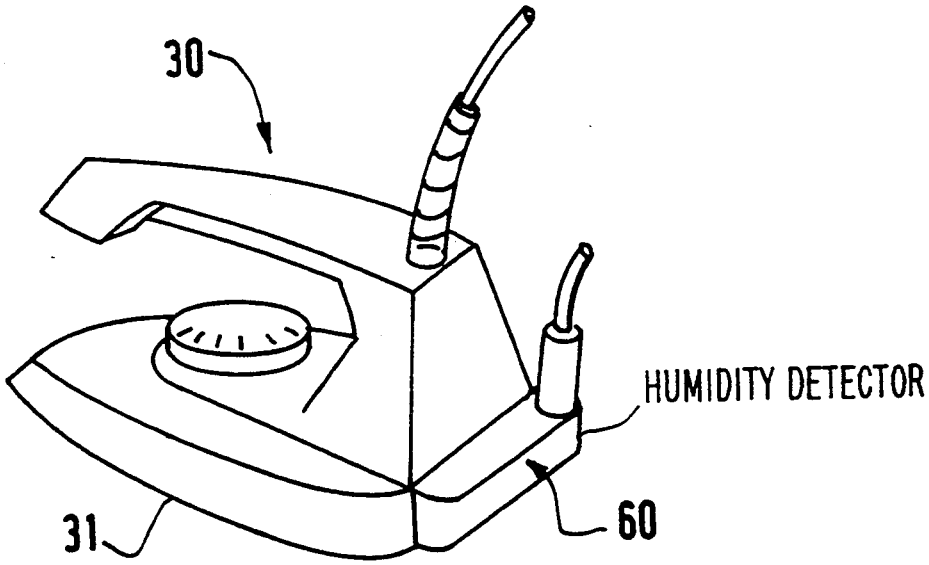
FIG. 1 is a perspective view of an example of an iron provided with a humidity detector.

FIG. 1 shows diagrammatically an iron 30 provided with a humidity detector 60 arranged at the back of the soleplate 31 of the iron.

Figure 2:
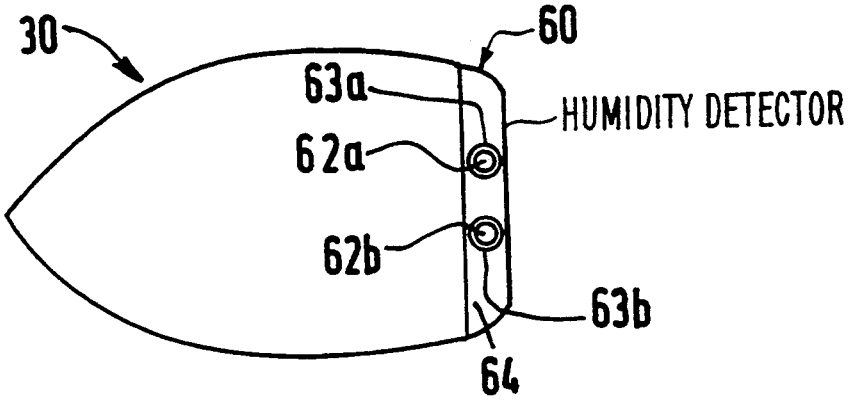
FIG. 2 is a diagrammatic underneath view of an iron provided with a humidity detector.

FIG. 2 is a diagrammatic underneath view of an iron 30 provided with a humidity detector 60. The detector 60 comprises two electrodes 62*a*, 62*b*, which preferably have a rounded shape, for example hemispheric, to slide easily on the fabric. For example, stainless steel electrodes of 5 mm to 10 mm diameter may be used. These electrodes may be arranged on an elastic base 64 for a good contact with the fabric without leaving any traces. These electrodes are connected to measurement means which determine the average amplitude of the signal I.

The electrodes are accommodated in recesses 63*a*, 63*b* formed in the base 64. The temperature resistance of the material of the base should be adequate to be brought into contact with more or less warm fabrics without degradation of the material.

Figure 3:
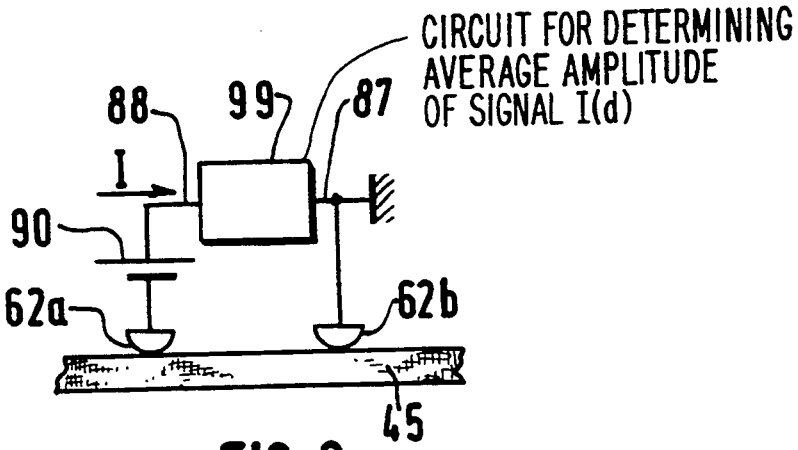
FIG. 3 is a diagram of an electrical measurement circuit.

As shown in FIG. 3, which is a diagram of an electrical resistance-measurement circuit, the electrodes 62*a*, 62*b*, which are in contact with the fabric 45, are connected to an electrical power supply 90 and to a circuit 99 for measuring the electric current I in the circuit.

Figure 4:
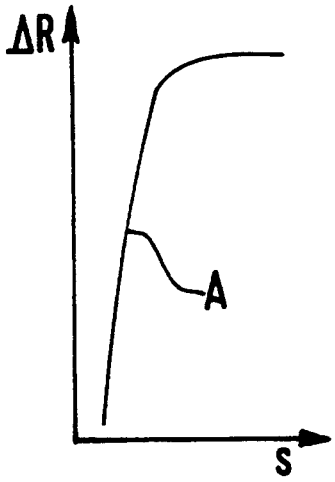
FIG. 4 is a curve representing the resistance variations ΔR during a drying operation.

FIG. 4 is a curve representing the resistance variations ΔR during a dehumidifying operation for an iron as shown in FIG. 2. When the iron is applied and subsequently moved in the direction of its front tip with a moderately warm soleplate the humidity detector 60 will meet fabric areas which become increasingly dry (over the soleplate length of the iron). This yields a curve A as a function of the degree of drying s. It is expressed in arbitrary units.

Figure 5:
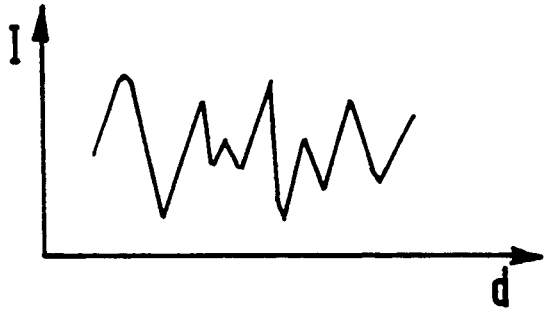
FIG. 5 is an example of a curve representing the variation of an output signal I (d) as a function of the displacement d.

FIG. 5 shows a curve representing the variation of an output signal I as a function of the displacement d of the iron. It is representative of a signal obtained from the humidity detector. The signal consists of a sequence of halfwaves of variable amplitude. To detect the degree of humidity the average value of this signal in a predetermined time interval is calculated.

Figure 6:
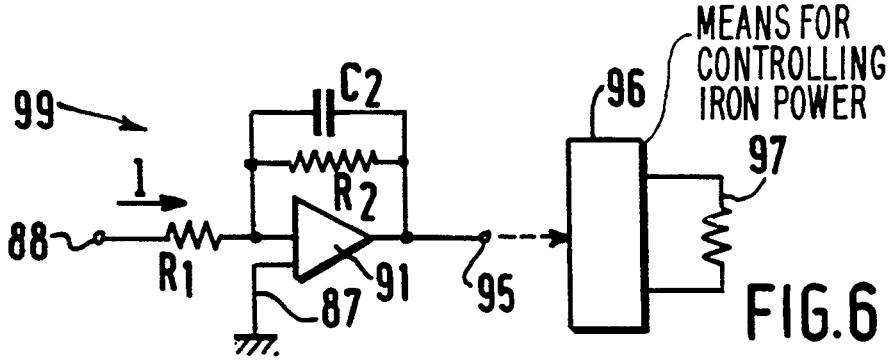
FIG. 6 shows an example of a circuit for measuring the average amplitude of the signal I.

FIG. 6 shows a circuit 99 which determines the average amplitude of the signal I (d). This average value is then representative of the degree of humidity of the fabric. The circuit comprises a resistor $R_1$ connected to the input terminal 88 receiving the current I. The other end of this resistor $R_1$ is connected to an input of an amplifier 91 having a high input impedance. A circuit comprising a capacitor $C_2$ and a resistor $R_2$ in parallel is arranged between the input and the output of this amplifier 91. Thus, a signal representing the average degree of humidity of the fabric appears on the output 95. This signal can then be used for influencing the means 96 for controlling the iron, for example in order to increase the electric power dissipated in the heated element 97 in order to speed up the rate of dehumidification of the fabric. The other input of the amplifier 91 may be connected to earth. The soleplate of the iron can now take the place of the electrode 62*b*. The humidity detector then comprises an electrode 62*a* and the soleplate 31 as the second electrode.

It is also possible to extend the circuit 91 with another circuit 89 which can calculate the rhythm of the variations of the signal I in order to detect a condition of use of the iron. In this case the means 89 comprise:

a differentiation circuit for the electric signal I, and a counter (93) which measures a number of pulses appearing on the output of the differentiation circuit and which stops the control means of the iron when this number of pulses is smaller than a very small predetermined number.

Figure 7:
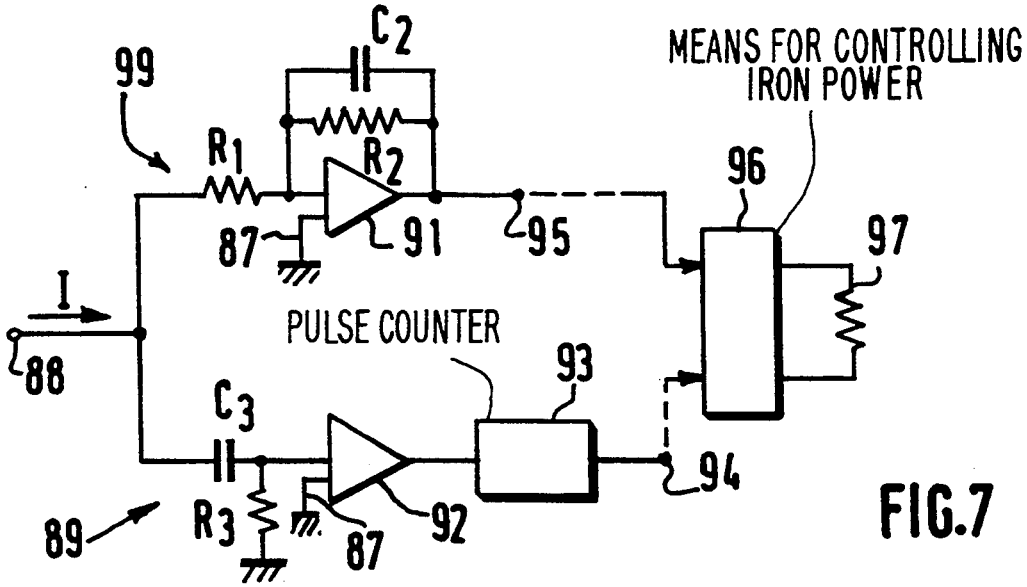
FIG. 7 shows an example of a circuit for measuring the average amplitude and the rhythm of the variations of the signal I.

FIG. 7 shows a circuit by means of which it is possible to determine the degree of humidity by measuring an average amplitude (branch 99) and detecting a condition of use of the iron by measuring a number of half-waves (branch 89). The branch 89 comprises a capacitor $C_3$ and a resistor $R_3$ connected to an input of an amplifier 92 having a high input impedance to derive the signal I and to supply pulses upon each rising and falling edge of the signal. These pulses are subsequently counted in a counter 93, which supplies a signal S on an output 94 when a limited number of pulses (for example 1 to 3) has appeared within a predetermined time interval. This signal is then used to influence the control means 96 of the iron in order to turn off the heating of the heating element 97.

We claim:

1. An iron comprising a heating element (97), heating-control means (96) for the heating element, and a substantially flat soleplate (31) adapted to slide on a fabric, wherein the iron has a humidity detector (60) comprising:

means (62*a*, 62*b*) for measuring a resistivity of the fabric, which means are flush with the soleplate of the iron to enable it to be brought into contact with the fabric and produce an electric signal (I) in response to movement of the said means (62*a*, 62*b*) on the surface of the fabric, means (99), operatively associated with said heating control means (96), for determining an average degree of humidity of the fabric by measuring said electric signal (I) produced by said means (62*a*, 62*b*) resulting from variations of the resistivity caused by a movement of the iron over the fabric.

2. An iron as claimed in claim 1, the means for measuring the resistivity comprise at least one electrode (62*a*), (62*b*).

3. An iron as claimed in claim 2 wherein the means (99) for determining the average degree of humidity comprise an amplifier having a high input impedance, which amplifier receives the signal (I) and has an input and an output interconnected by a feedback resistor.

4. An iron as claimed in claim 2 which comprises means (89), operatively associated with said heating control means (96), for detecting the movement of the iron by measuring a rhythm of variations of said electric signal.

5. An iron as claimed in claim 4 wherein the means (89) for determining the movement comprise:

a differentiation circuit for the electric signal (I), and a counter (93) which measures a number of pulses appearing on an output of the differentiation circuit and which stops the heating-control means of the iron when said number of pulses is smaller than a predetermined number.

6. An iron as claimed in claim 1 wherein the means (99) for determining the average degree of humidity comprise an amplifier having a high input impedance, which amplifier receives the signal (I) and has an input and an output interconnected by a feedback resistor.

7. An iron as claimed in claim 6 which comprises means (89), operatively associated with said heating control means (96), for detecting the movement of the iron by measuring a rhythm of variations of said electric signal.

8. An iron as claimed in claim 7 wherein the means (89) for determining the movement comprise:

a differentiation circuit for the electric signal (I), and a counter (93) which measures a number of pulses appearing on an output of the differentiation circuit and which stops the heating-control means of the iron when said number of pulses is smaller than a predetermined number.

9. An iron as claimed in claim 1, which comprises means (89), operatively associated with said heating control means (96), for detecting the movement of the iron by measuring a rhythm of variations of said electric signal.

10. An iron as claimed in claim 9, wherein the means (89) for determining the movement comprise:

a differentiation circuit for the electric signal (I), and a counter (93) which measures a number of pulses appearing on an output of the differentiation circuit and which stops the heating-control means of the iron when said number of pulses is smaller than a very small predetermined number.

* * * * *